US006886191B2

(12) United States Patent
Zolotnik

(10) Patent No.: US 6,886,191 B2
(45) Date of Patent: May 3, 2005

(54) SOAKING BASIN AND DISPOSABLE LINER

(76) Inventor: Vladimir Zolotnik, 7308 Easthaven La., West Hills, CA (US) 91307

( * ) Notice: Subject to any disclaimer, the term of this patent is extended or adjusted under 35 U.S.C. 154(b) by 0 days.

(21) Appl. No.: 10/421,406

(22) Filed: Apr. 22, 2003

(65) Prior Publication Data

US 2004/0003460 A1 Jan. 8, 2004

Related U.S. Application Data

(63) Continuation-in-part of application No. 10/191,263, filed on Jul. 5, 2002.

(51) Int. Cl.[7] ..... E03C 1/00
(52) U.S. Cl. ..... 4/622; 4/619; 4/621; 4/655
(58) Field of Search ..... 4/622, 655, 619, 4/621, 639, 641, 643, DIG. 18; 132/75, 73, 73.6, 74.5; D28/56

(56) References Cited

U.S. PATENT DOCUMENTS 4,307,738 A * 12/1981 Barns ..... 132/74.5
5,588,161 A * 12/1996 Barradas ..... 4/662
5,729,841 A * 3/1998 Chan ..... 4/622
6,598,244 B1 * 7/2003 Yeh ..... 4/622
6,695,800 B1 * 2/2004 Gary et al. ..... 601/154

* cited by examiner

*Primary Examiner*—Henry Bennett
*Assistant Examiner*—Amanda Wieker
(74) *Attorney, Agent, or Firm*—Freilich, Hornbaker & Rosen

(57) ABSTRACT

A soaking apparatus utilizing a soaking basin and a disposable liner configured to fit within the basin cavity. The basin is comprised of a material layer formed to define an integral floor and a peripheral wall projecting upwardly therefrom. The basin floor and peripheral wall together define the boundary of a basin cavity. An elongate protrusion protrudes from the floor into the basin cavity between left and right foot areas. The liner is comprised of a thin (e.g., 3–12 mils) material layer formed to define an integral floor and peripheral wall projecting upwardly therefrom. The liner floor and peripheral wall are dimensioned to closely nest within the basin cavity. The liner floor also defines left and right foot areas spaced by a protrusion projecting into the liner cavity. The underside of the liner protrusion forms a concave recess for accommodating the basin floor protrusion.

12 Claims, 8 Drawing Sheets

52
54

44

50
58

34
20
22
44
B
54
50
A
42
40
A
B
52
24

32

D
32
34
C
28
36
26
24
50

F
F
G
G
76
94
60
64

98
76
94

74
84
62
70
H
76
78
68
66
64

94

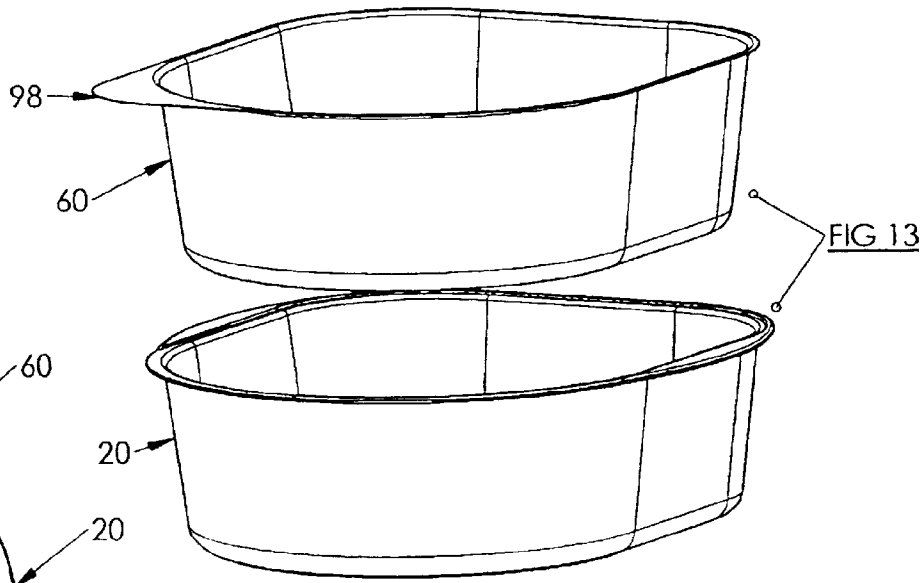
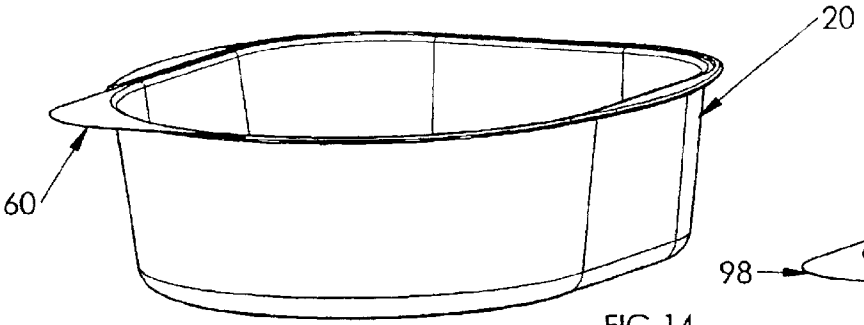
FIG 14
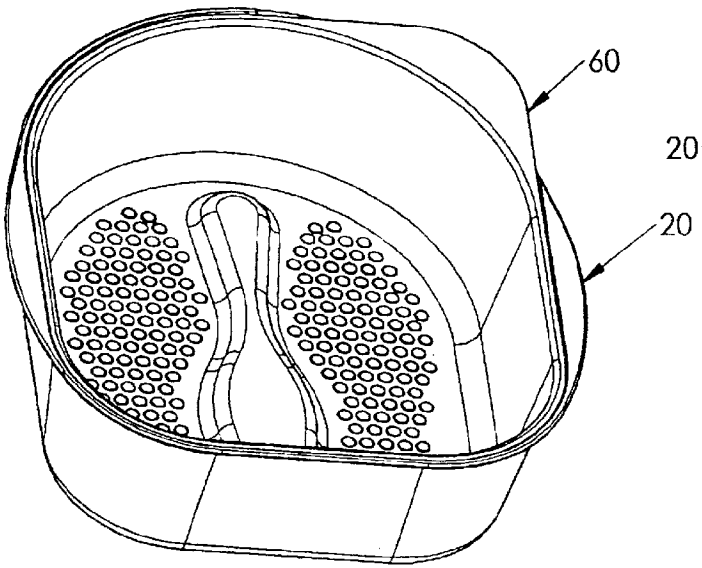
FIG 15

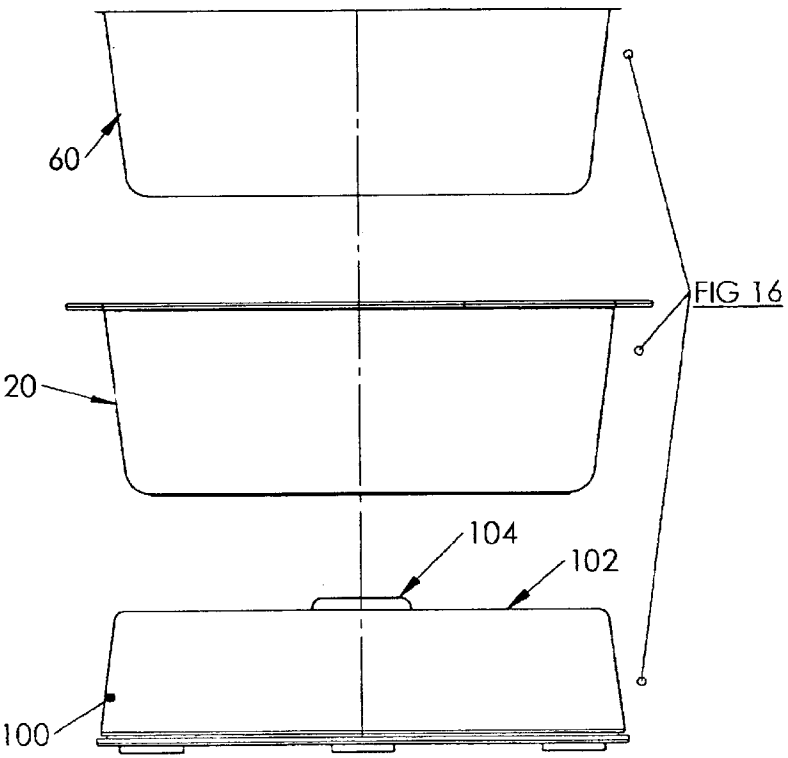
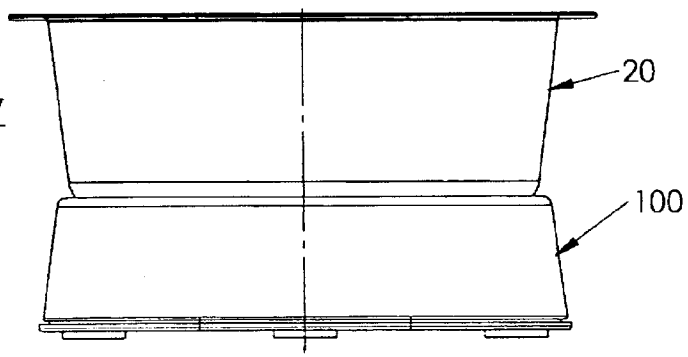
FIG 17
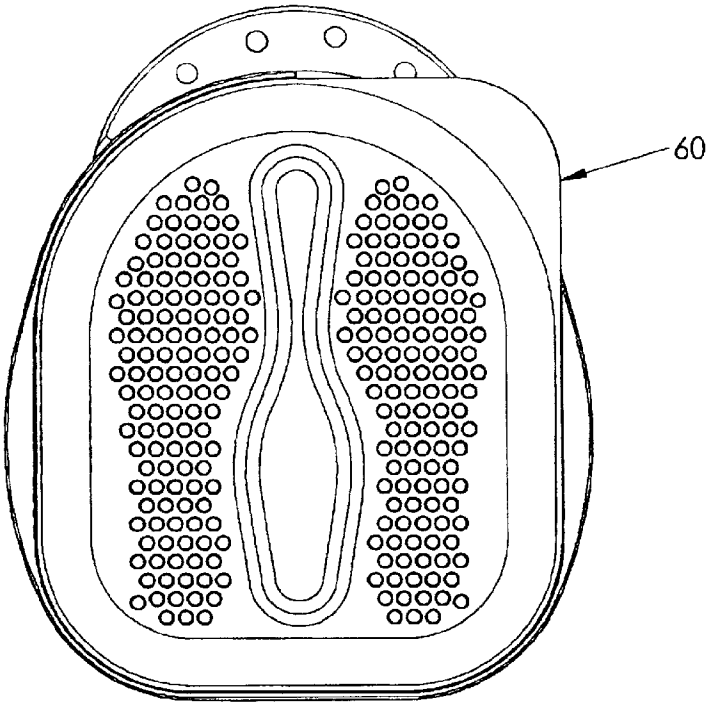
FIG 18

SOAKING BASIN AND DISPOSABLE LINER

RELATED APPLICATIONS

This application is a continuation-in-part of U.S. application Ser. No. 10/191,263 filed Jul. 5, 2002.

FIELD OF THE INVENTION

This application relates generally to apparatus for soaking a user's feet and/or hands and more particularly to a soaking basin and disposable liner therefor for reducing the risk of cross infection amongst multiple users.

BACKGROUND OF THE INVENTION

Patrons of nail salons customarily soak their feet and/or hands to soften the skin and nails in the course of receiving a pedicure and/or manicure. A typical salon uses a soaking basin which generally serves many customers. Despite the use of a germicide and frequent replacement of the soaking liquid, a high risk exists that certain infectious organisms may be transmitted amongst the multiple users. The present invention is directed primarily to soaking apparatus configured to reduce the risk of cross infection without unduly encumbering the pedicure and/or manicure procedures for either the salon operator or patrons.

SUMMARY OF THE INVENTION

The present invention is directed to an improved soaking apparatus utilizing a soaking basin and a disposable liner configured to fit within the basin cavity. The liner is preferably formed of a thin, liquid impermeable, material, e.g., a plastic or rubber-like material, which can be fabricated at a sufficiently low cost so that the liner is suitable for single use, i.e., disposable, applications. In typical use, the disposable liner will be placed in a reusable basin and then filled with a soaking liquid for use by a single person. After such use, the liner and its contents will be discarded and a new liner will be placed in the basin for a subsequent user. As a consequence, any risk of cross infection is substantially reduced.

A preferred basin structure in accordance with the invention is comprised of a planar material layer formed to define an integral floor and a peripheral wall projecting upwardly therefrom. The basin floor and peripheral wall together define the boundary of a basin cavity. The basin floor is preferably shaped to define a left foot area and a right foot area. An elongate protrusion protrudes from the floor into the basin cavity between the left and right foot areas.

A preferred liner structure in accordance with the invention is comprised of a thin (e.g., 3–12 mils) planar material layer formed to define an integral floor and peripheral wall projecting upwardly therefrom. The liner floor and peripheral wall together define the boundary of a liner cavity. The liner floor and peripheral wall are dimensioned to closely nest within the basin cavity. The liner floor also defines left and right foot areas spaced by a protrusion projecting into the liner cavity. The underside of the liner protrusion forms a concave recess for accommodating the basin floor protrusion.

A preferred liner embodiment includes a plurality of bumps in the left and right foot areas for engaging the soles of a users feet. The bumps provide point contact against the user's soles thus lifting the user's soles to provide for a layer of soaking liquid therebeneath.

The preferred liner embodiment includes an outwardly extending peripheral lip at the upper end of the liner peripheral wall. This lip is configured to nest in a recess formed in a lip extending outward at the upper end of the basin peripheral wall. A tab preferably extends outwardly from the liner lip to facilitate manual handling of the liner as the liner is placed into and removed from the basin.

The basin preferably has a floor which is apertured to prevent the basin from being used without a liner. This is desirable because such basins could otherwise be used for multiple patrons and would avoid the cross infection protection afforded by liner use in accordance with the invention.

In accordance with a further feature of the invention, a basin base is provided for supporting the basin. The basin base is configured to gently heat and vibrate the basin to heat and agitate the soaking liquid contained by the liner.

BRIEF DESCRIPTION OF THE FIGURES

FIG. 13 is an isometric view showing how the liner of FIG. 7 is placed into the basin of FIG. 1;

FIGS. 14 and 15 represent different isometric views of the liner of FIG. 7 nested in the basin of FIG. 1;

FIG. 16 schematically shows an exploded end view depicting how a liner and a basin can be nested and supported on a base unit;

FIG. 17 is a schematic end view showing the liner and basin supported on the base unit;

FIG. 18 is a top plan view of the liner, basin, and base unit;

DETAILED DESCRIPTION

Figures 1, 2A, 2B, 2C, 2D, 3, 4, 5:
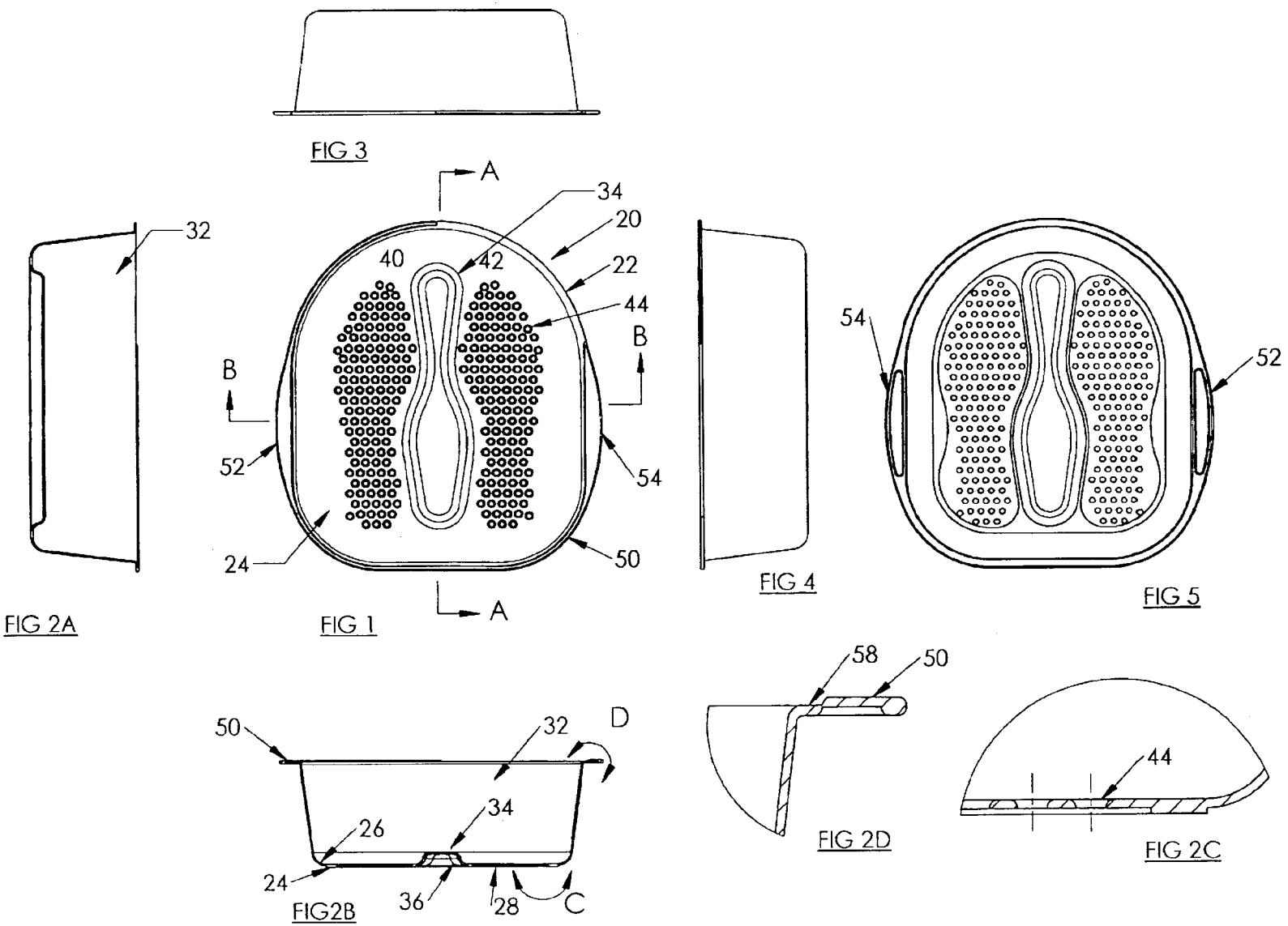
FIG. 1 is a top plan view of a preferred basin in accordance with the present invention.
FIG. 2A is a sectional view taken substantially along the plane A—A of FIG. 1.
FIG. 2B is a sectional view taken substantially along the plane B—B of FIG. 1.
FIG. 2C is an enlarged detailed view of the C region of FIG. 2B.
FIG. 2D is an enlarged detailed view of the D region of FIG. 2B.
FIG. 3 is an end view of the basin shown in FIG. 1.
FIG. 4 is a side view of the basin shown in FIG. 1.
FIG. 5 is a bottom plan view of the basin shown in FIG. 1.
Figure 6:
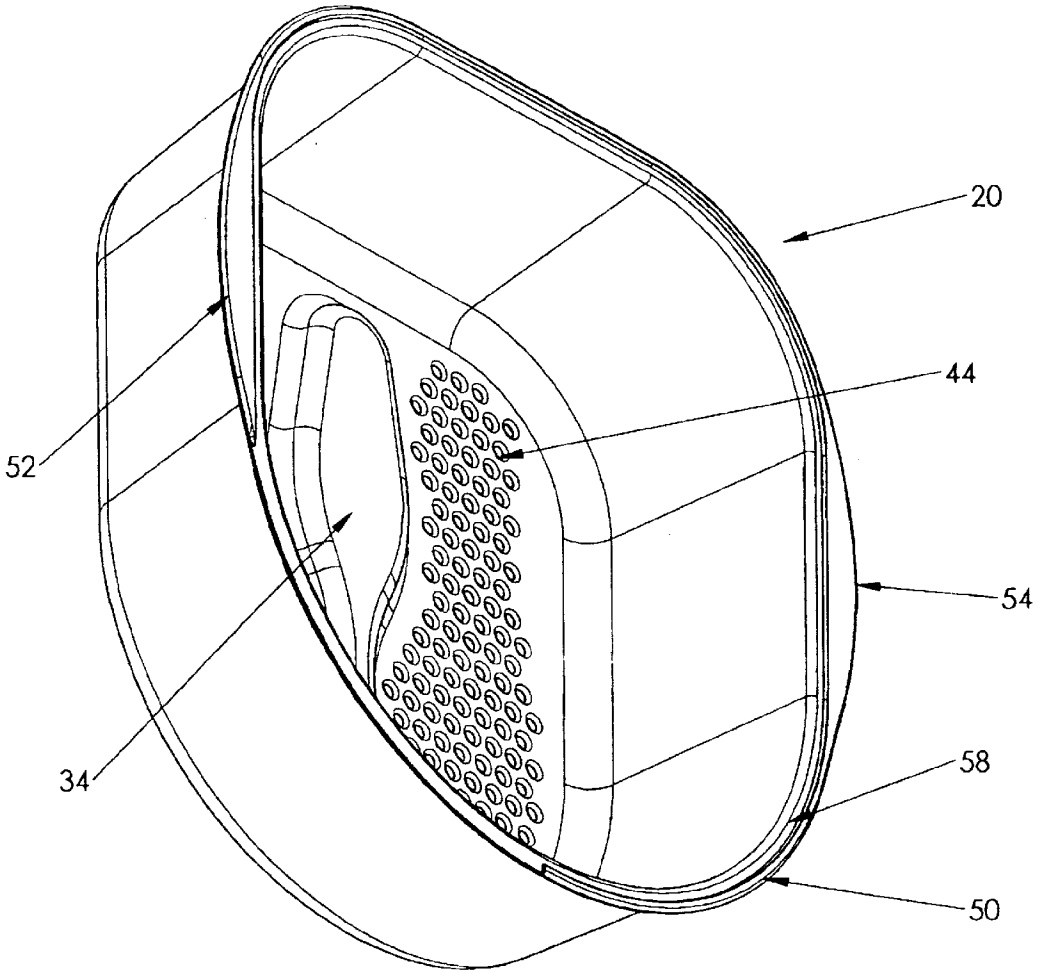
FIG. 6 is an isometric view of the preferred basin shown in FIG. 1.
Figures 7, 8A, 8B, 8C, 9, 10, 11:
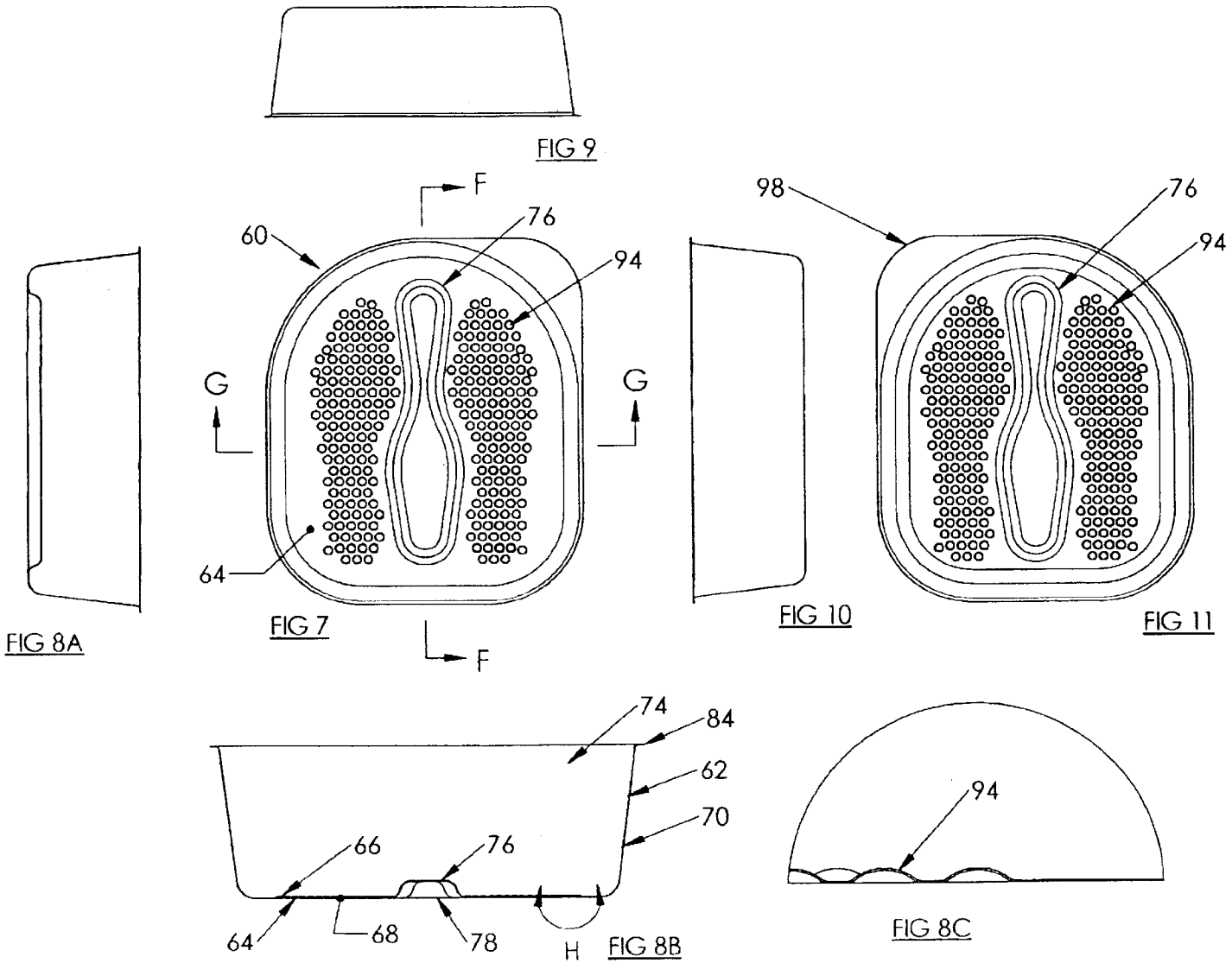
FIG. 7 is a top plan view of a preferred basin liner in accordance with the present invention.
FIG. 8A is a sectional view taken substantially along the plane F—F of FIG. 7.
FIG. 8B is a sectional view taken substantially along the plane G—G of FIG. 7.
FIG. 8C is an enlarged view showing the detail of the H region of FIG. 8B.
FIG. 9 is an end view of the liner of FIG. 7.
FIG. 10 is a side view of the liner of FIG. 7.
FIG. 11 is a bottom plan view of the liner of FIG. 7.
Figure 12:
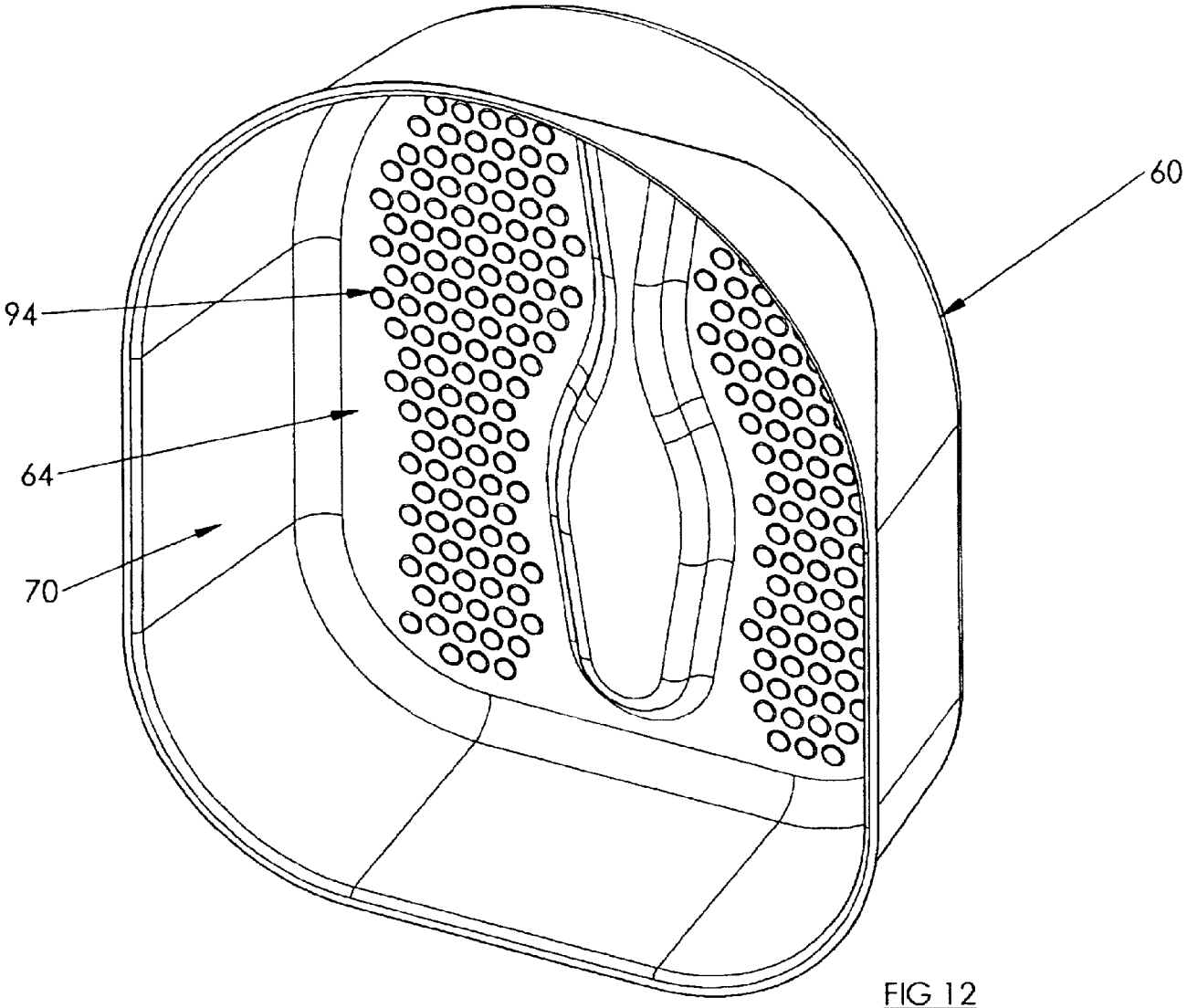
FIG. 12 is an isometric view of the liner of FIG. 7.
Figure 19:
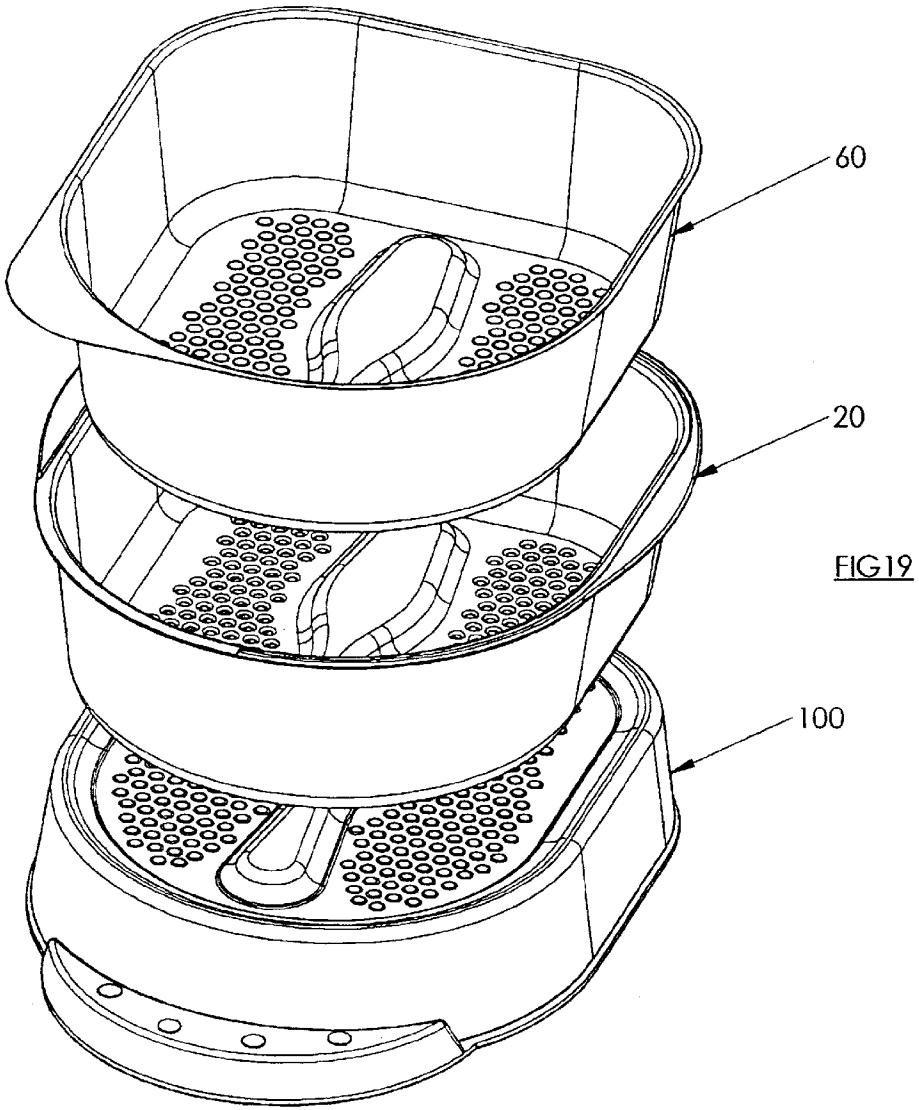
FIG. 19 is an isometric exploded view showing the liner, basin, and base unit.

Attention is initially directed to FIGS. 1–6 which depict a preferred soaking basin 20 in accordance with the present invention. The basin 20 is comprised of a layer of substantially planar material 22, e.g., plastic, shaped to form a basin floor 24 having an upper floor surface 26 and a lower floor surface 28. The floor 24 is formed integral with a peripheral wall 30 which extends upwardly from the floor 24, preferably tilting outwardly at a small angle. The floor 24, in combination with the peripheral wall 30, forms the boundary of a basin cavity 32.

It is pointed out that the floor 24 includes an elongate protrusion 34 which protrudes into the basin cavity 32. The underside of the protrusion 34 defines a concave recess 36 extending into floor lower surface 28. The profile of protrusion 34 can take many different arbitrary shapes, e.g., the bowling pin shape depicted in FIG. 1. Regardless, the protrusion 34 functions to separate the floor upper surface 26 into first and second floor areas 40, 42. The areas 40 and 42 are shaped and dimensioned to comfortably accommodate a typical user's left foot and right foot, respectively. The areas 40 and 42 preferably contain apertures 44 so that the basin 20 does not hold liquid without utilization of a liner to be discussed hereinafter.

It is further pointed out that the upper region of the basin peripheral wall 30 extends outwardly to form a lip 50. A portion of the lip is enlarged at 52 and 54 to form carrying handles. The lip is preferably recessed at 58 (FIG. 2D) to accommodate the lip of a liner to be discussed hereinafter.

Attention is now directed to FIGS. 7–12 which illustrate a preferred disposable liner 60 in accordance with the present invention intended to be used in conjunction with the aforedescribed reusable basin 20. The liner 60 is comprised of a substantially planar, liquid impermeable, material layer 62. For example, the material layer 62 can comprise a thin transparent plastic or rubber-like material having a thickness within the range of 3–12 mils. The layer 62 is formed to define a liner floor 64 having an upper surface 66 and a lower surface 68. A peripheral wall 70 extends upwardly and slightly outwardly from the floor 64. The floor 64 in combination with the peripheral wall 70, forms the boundary of a liner cavity 74.

The liner floor 64 defines an elongate protrusion 76 which protrudes into the liner cavity 74. The underside of the protrusion 76 defines a concave recess 78 extending into floor lower surface 68.

The liner 60 is shaped substantially the same as basin 20 and dimensioned slightly smaller so that the liner can be readily closely accommodated in the basin cavity 32. The basin protrusion 34 is dimensioned to nest in liner recess 78. The placement of the liner 60 into the basin 20 is depicted in FIGS. 13, 14 and 15. Note that the liner peripheral wall 70 terminates at its upper end in an outwardly extending lip 84. The liner lip 84 is positioned and dimensioned to be received in the recess 58 of basin lip 50 FIG. 2D.

It is further pointed out that the liner floor 64 defines first and second areas 88 and 90 positioned on opposite sides of the elongate protrusion 76. Note that the areas 88 and 90 are shaped to correspond to basin areas 40 and 42 to comfortably accommodate a typical user's left foot and right foot. The liner floor 64 preferably also defines a plurality of bumps 94 which protrude from upper surface 66 into the liner cavity 74. These bumps 94 are positioned in the areas 88 and 90 and serve to provide points of contact against the soles of a user's feet.

In accordance with the invention, the liner 60 will be placed into the basin cavity 32 thereby covering the basin apertures 44. The liner 60 is formed of a liquid impermeable material enabling the liner cavity 74 to hold a soaking liquid. In use, after insertion of the liner 60 into the basin 20, the liner cavity 74 will be filled with an appropriate soaking liquid. The user will then place his left foot on liner floor area 88 and his right foot on area 90. The liner floor 64 will be supported by the basin floor 24 with the liner protrusion 76 being supported on the basin protrusion 34. It should be recognized that the liner can be formed of a very thin inexpensive and flexible material having very little rigidity on its own. However, the basin is formed of a substantially rigid material to thereby structurally support the liner along its peripheral wall as well as under the liner floor. It is intended that the liner be disposable and that the basin be reusable. That is, after each use, the liner and its contents should be discarded and a new liner placed in the basin for a subsequent user.

With the user's soles resting on the protruding bumps 94, the soaking liquid (not shown) will form a comforting layer beneath the user's soles. The bumps 94 offer comfortable point pressure against the user's soles and permit the formation of a lubricating liquid layer under the soles to prevent the soles from sticking to the liner floor. As has been noted, the liner lip 84 will rest in the basin lip recess 58 thereby recessing the edge of the liner lip and reducing the possibility of the liner edge cutting a user's finger when the liner is placed in or removed from the basin. To facilitate easy handling of the liner, at least one corner of the liner lip is extended at 98 to form a manual tab.

In the simplest utilization of the basin 20 and liner 60, they are used together without any additional apparatus. However, in a preferred utilization of the invention as depicted in FIGS. 16–18, a special base 100 is provided for supporting the basin 20. The base 100 provides a supporting platform 102 preferably having a protrusion 104 configured to be accommodated in the concave recess 36 in the basin floor 24.

Figure 20:
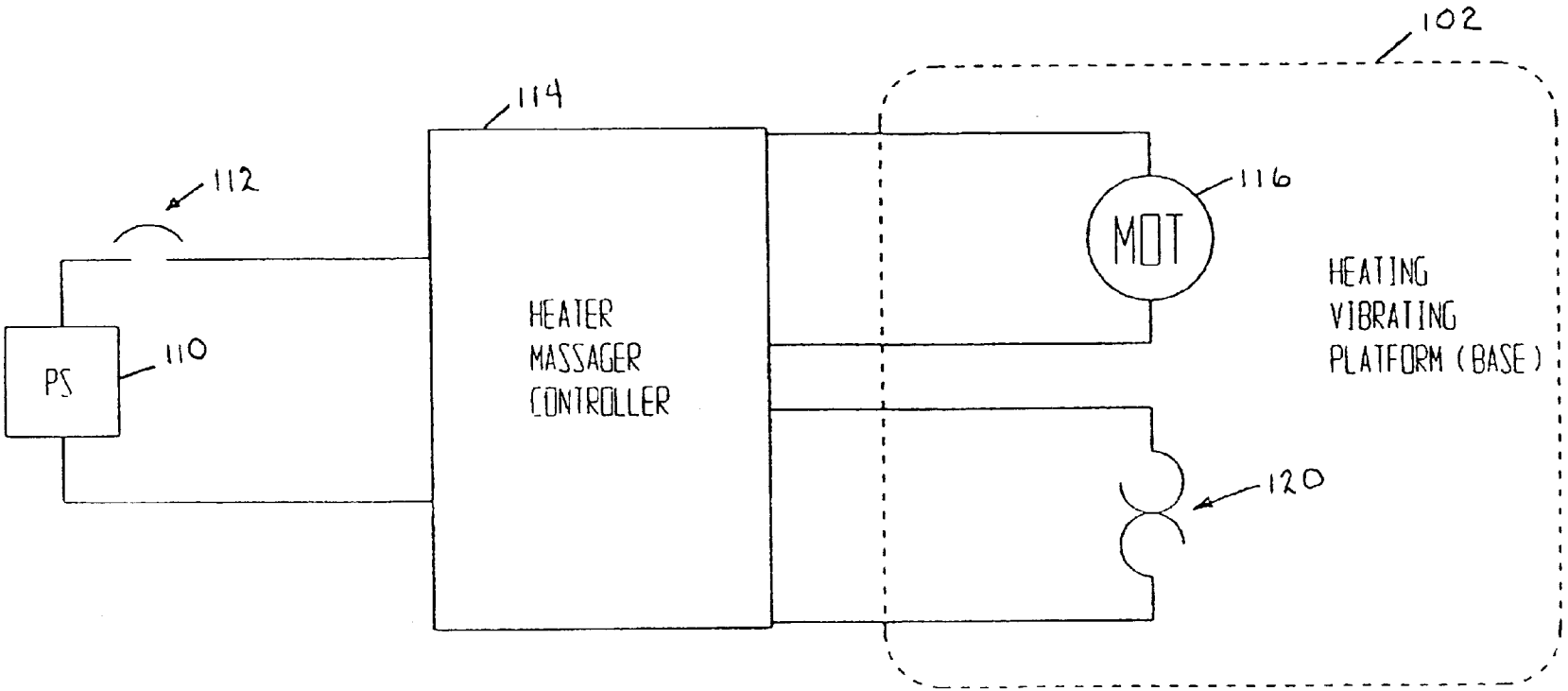
FIG. 20 is a schematic diagram showing the functional electronics used in the base unit of FIGS. 16–19 to provide heat and vibration.

FIG. 20 illustrates a preferred functional configuration of the base 100 for mechanically vibrating and/or heating the soaking liquid within the basin 20 and liner 60. More particularly, FIG. 20 depicts a power supply 110 connected through a manual switch 112 to a controller 114 which can be manually and/or automatically controlled. The controller can selectively control a motor 116 which is coupled to the platform supporting the basin 20. When actuated, the motor 116 vibrates the platform 102 by driving, for example, an eccentrically mounted weight (not shown). The platform vibration can transfer through the bumps 94 to produce a massaging effect on the user's soles. Additionally, electric and/or magnetic field generating means (not shown) can be incorporated in the base platform 102 to produce therapeutic effects. These field generating means are preferably controlled by controller 114 operating either in a manual mode or an automatic, e.g., programmed, mode.

Controller 114 preferably also selectively controls a heater 120 which provides heat to the platform 102 for transfer to the soaking liquid in liner 60 and basin 20.

Although the foregoing describes a single preferred embodiment of the invention, it is recognized that many variations and alternatives may occur to those skilled in the art consistent with the teachings herein. For example only, it is pointed out that the shape of protrusions 34, 76 can readily depart from the preferred bowling pin shape illustrated. Similarly, the shapes of the liner and basin can be modified. Moreover, although desirable, it is not essential in accordance with the invention that the liner and cavity define the same shape. It is also pointed out that although the base 100 is preferably used in combination with a reusable basin 20 and disposable liner 60, it should be understood that the base can alternatively be used with a liquid imperable basin without a liner.

Other variations and modifications will undoubtedly occur to those skilled in the art based on the teachings herein. It is accordingly intended that variations and alternatives be encompassed by the scope of the appended claims.

What is claimed is:

1. In combination:

a base member defining a supporting platform and including means actuatable to vibrate said platform;

a basin member including a basin floor and a basin peripheral wall forming a basin cavity suitable for containing a soaking solution, said basin member being comprised of substantially rigid material to allow said basin member to be readily carried with said soaking solution contained in said cavity;

means for coupling said basin member to said platform without screw fasteners for transferring platform vibratory motion to said basin member and for allowing only said basin member and its contents to be quickly removed from said platform for discarding said soaking solution; and wherein said means for coupling includes a concave recess formed on one of said members and a protrusion formed on the other of said members where said protrusion is shaped and dimensioned to nest in said recess for coupling said platform and said basin member.

2. The combination of claim 1 wherein said means for coupling comprises:

a protrusion extending upwardly from said base member platform; and a concave recess formed on the underside of said basin member floor for accommodating said protrusion.

3. The combination of claim 2 wherein said base member further includes means actuatable to produce heat for transfer through said platform and said basin member floor to said soaking solution.

4. The combination of claim 1 wherein said basin member is comprised of a reusable basin and a removable liner shaped and dimensioned to nest in said basin.

5. The combination of claim 4 wherein said liner is formed of a planar, liquid impermeable material layer formed to define a liner floor and a liner peripheral wall projecting upwardly from said liner floor to form a boundary defining a liner cavity for containing said soaking solution; and a plurality of spaced bumps formed in said liner floor projecting into said liner cavity for contacting and massaging a users skin.

6. The combination of claim 4 wherein said liner is comprised of a planar, liquid impermeable material layer formed to define a liner floor and a liner peripheral wall projecting upwardly from said liner floor to form a boundary defining a liner cavity; and wherein said basin is comprised of a substantially rigid material layer formed to define a basin floor and a basin peripheral wall projecting upwardly from said basin floor and wherein said basin floor includes at least one aperture to prevent said basin from holding liquid in the absence of said liner nested therein.

7. In combination:

a base member defining a supporting platform and including means actuatable to heat said platform;

a basin member including a basin floor and a basin peripheral wall forming a basin cavity suitable for containing a soaking solution, said basin member being comprised of substantially rigid material to enable the basin member to be readily carried with a soaking solution pool contained in said cavity;

means for coupling said basin member to said platform without screw fasteners for transferring platform heat to said basin member and for allowing only said basin member and its contents to be quickly removed from said platform for discarding said soaking solution; and wherein said means for coupling includes a concave recess formed on one of said members and a protrusion formed on the other of said members where said protrusion is shaped and dimensioned to nest in said recess for coupling said platform and said basin member.

8. The combination of claim 7 wherein said means for coupling comprises:

a protrusion extending upwardly from said base base member platform; and a concave recess formed on the underside of said basin member floor for accommodating said protrusion.

9. The combination of claim 8 wherein said base member further includes means actuatable to vibrate said base unit platform and said basin member to agitate said soaking solution.

10. The combination of claim 7 wherein said basin member is comprised of a reusable basin and a removable liner shaped and dimensioned to nest in said basin.

11. The combination of claim 7 wherein said liner is formed of a planar, liquid impermeable material layer formed to define a liner floor and a liner peripheral wall projecting upwardly from said liner floor to form a boundary defining a liner cavity for containing said soaking solution; and a plurality of spaced bumps formed in said liner floor projecting into said liner cavity for contacting and massaging a user's skin.

12. The combination of claim 7 wherein said liner is comprised of a planar, liquid impermeable material layer formed to define a liner floor and a liner peripheral wall projecting upwardly from said liner floor to form a boundary defining a liner cavity; and wherein said basin is comprised of a substantially rigid material layer formed to define a basin floor and a basin peripheral wall projecting upwardly from said basin floor and wherein said basin floor includes at least one aperture to prevent said basin from holding liquid in the absence of said liner nested therein.

* * * * *